US005697358A

United States Patent [19]

Campisi

[11] Patent Number: 5,697,358

[45] Date of Patent: Dec. 16, 1997

[54] REVERSIBLE RISER FOR ARCHERY BOW ENABLING LEFT AND RIGHT HAND USE

[76] Inventor: Curtis Campisi, 8705 El Matador Dr., Gilroy, Calif. 95020-9417

[21] Appl. No.: 584,458

[22] Filed: Jan. 11, 1996

[51] Int. Cl.[6] ..... F41B 5/00

[52] U.S. Cl. ..... 124/88; 124/23.1

[58] Field of Search ..... 124/86, 88, 23.1, 124/25.6

[56] References Cited

U.S. PATENT DOCUMENTS

| | | | |
|---|---|---|---|
| 2,957,469 | 10/1960 | Wilkerson | 124/88 X |
| 3,923,036 | 12/1975 | Jennings et al. | 124/88 |
| 4,457,287 | 7/1984 | Babington | 124/23.1 |
| 4,725,295 | 2/1988 | Guzzetta | 124/25.6 X |
| 5,099,819 | 3/1992 | Simonds et al. | 124/88 X |
| 5,113,841 | 5/1992 | Bratcher | 124/23.1 |
| 5,280,779 | 1/1994 | Smith | 124/88 |
| 5,335,644 | 8/1994 | Smith et al. | 124/25.6 X |
| 5,520,164 | 5/1996 | Huddleston | 124/86 |
| 5,551,413 | 9/1996 | Walk | 124/88 |

*Primary Examiner*—Terry Lee Melius
*Assistant Examiner*—Thomas A. Beach
*Attorney, Agent, or Firm*—Roy A. Ekstrand

[57] ABSTRACT

An archery bow includes an elongated riser having an upper beam, a lower beam and an intermediate handle support. The riser defines a vertical axis of symmetry extending through the upper beam, lower beam and handle support. The riser is symmetrical about the axis of symmetry to define mirror image portions. A pair of limb pocket assemblies are securable to the upper and lower beams of the riser from either side with respect to the axis of symmetry. A handle grip or handle together with an overdraw guard and arrow rest are securable to either side of the riser in mirror image attachments. A cable guard constructed in accordance with conventional fabrication techniques is securable to the riser so as to extend from either side of the riser with respect to the access of symmetry. The limb pocket assemblies, handle, overdraw guard, arrow rest, and cable guard are attachable to the riser from either side with respect to the axis of symmetry to facilitate configuration of the resulting archery bow for use by either right-handed or left-handed archers.

9 Claims, 3 Drawing Sheets

REVERSIBLE RISER FOR ARCHERY BOW ENABLING LEFT AND RIGHT HAND USE

SPECIFICATION

1. Field of the Invention

This invention relates generally to bows used in archery and particularly to the riser used to support the flexible limbs of the bow.

2. Background of the Invention

The sport of archery has enjoyed ever increasing popularity among a wide group of enthusiasts. The apparatus used in both target shooting and hunting has evolved to a considerable level of sophistication. To increase the power and accuracy of archery apparatus, practitioners in the art have developed so-called recurved bows as well as compound bows. The latter bows are particularly powerful and are able to impart extraordinary energy to the arrows which they shoot. In a typical compound bow, an elongated rigid center portion, called a riser, defines a hand grip and supports a pair of extending flexible limbs on either end of the riser. Each limb has a free end which supports a rotatable eccentric wheel or cam to which a pair of cables and a bow string are secured. An arrow rest is supported upon the riser in some fashion to support the forward portion of the arrow shaft as the bow is drawn and aimed.

Arrows themselves have enjoyed considerable development and have evolved from simple wooden shaft implements with feather fletchings and fixed arrow heads or points to modern high strength lightweight arrows using hollow aluminum alloy shafts or composite materials which support threaded inserts and removable interchangeable points or heads. The traditional feather fletchings have generally been replaced by plastic fletchings or vanes and the arrow nock is typically formed of a high strength molded material such as plastic or the like.

When an archer fits an arrow to the bow, the nock is fitted to the bow string at a point referred to as the nocking point and the front portion of the arrow is rested within the arrow rest. The arrow and bow string are then drawn back flexing the limbs and rotating the eccentric wheels to store energy in the bow. Once the bow is drawn, the nocking point on the bow string and the arrow rest define an axis often referred to as the shooting axis along which the arrow is launched when the bow string of the drawn bow is released.

More specifically, as the archer initially fits the arrow nock to the bowstring, the arrow shaft is rested upon the arrow rest or lays loosely upon the side of the bow. At this point, the archer then grips the handle on the bow riser with one hand while beginning to draw the arrow and string back flexing the bow with the other hand. Usually, as the archer draws the bow, he or she also begins leveling the arrow and taking an initial aim. Once the bow is fully drawn, most archers then complete or refine their aim and once satisfied with the aim, the archer releases the bowstring to launch the arrow. In most instances, a right-handed archer prefers to hold the bow handle with the left hand while using the stronger and more developed right arm and hand to draw the bow. Conversely, of course, a left-handed archer usually prefers to hold the bow handle with the right hand while drawing the bow with the left hand. While a simple or primitive bow may be reversible to accommodate left and right hand archers, modern more sophisticated and higher technology bows such as recurved bows and compounds bows are not symmetrical and thus are not capable of use by both right and left-handed archers. As a result, such bows are fabricated in both right and left hand models. One can readily see that this need to stock both right and left hand bows greatly increases the inventory required in an archery shop. In addition, certain associated equipment used with such modern bows must also be stocked in right and left hand versions further increasing the archery shops inventory. An added complication arises for many archers who are left-handed in that the greater percentage of archers are likely to be right-handed since the general population includes many more right-handed persons than left-handed persons. This uneven distribution of right and left-handed population often causes archery shops to "play the percentage" by stocking substantially greater quantities and selections for right-handed archers and skimping on left-handed versions of the same equipment. All too often, a left-handed archer is required to order equipment and wait for delivery while a right-handed archer is able to obtain equipment immediately.

In order to alleviate a substantial portion of this inventory problem, there arises a need in the art for a reversible bow which, despite its reversible construction, does not compromise on technology use or performance.

SUMMARY OF THE INVENTION

Accordingly, it is a general object of the present invention to provide an improved archery bow. It is a more particular object of the present invention to provide a reversible riser for archery bow which enables both right and left hand use without sacrificing the performance or capability of the bow.

In accordance with the present invention, there is provided an archery bow comprising: a riser defining an upper beam, a handle support, a lower beam and a vertical axis of symmetry extending through the riser, the riser being substantially symmetrical in a front-to-back plane passing through the axis of symmetry; a pair of limb pocket assemblies secured to the upper beam and the lower beam; a pair of flexible limbs secured to the pair of limb pocket assemblies; and a handle secured to the handle support, the pair of limb pocket assemblies and the handle being alternatively securable to the riser at opposed positions with respect to the axis of symmetry to configure the archery bow for left-handed and right-handed archers.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
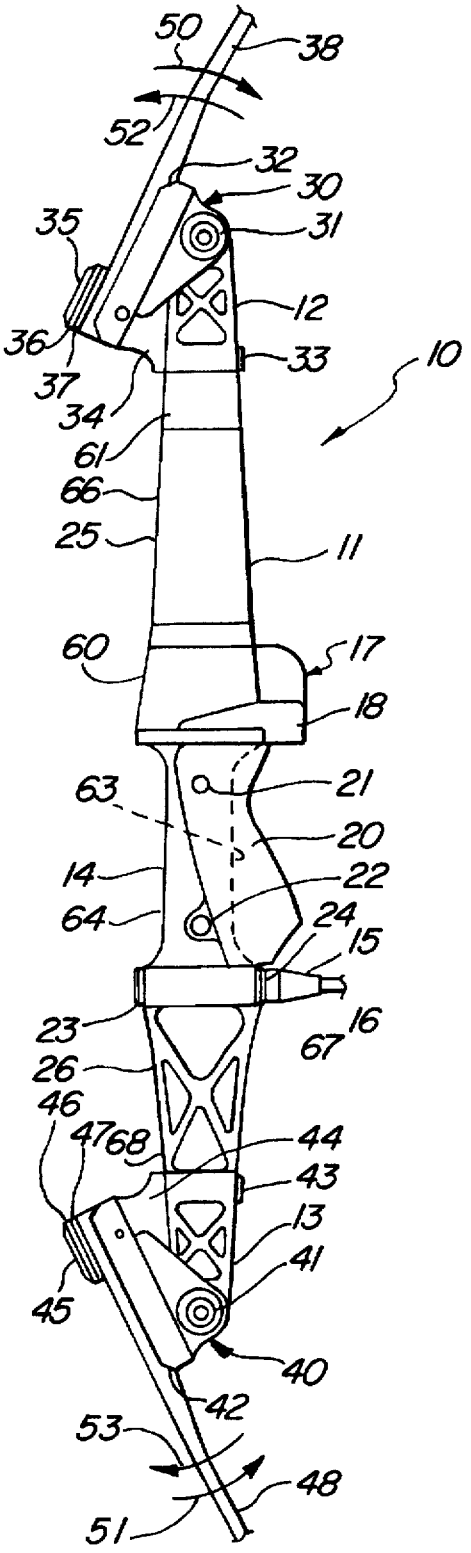
FIG. 1 sets forth a partial side view of a bow having a riser constructed in accordance with the present invention configured for use by a right hand archer.

FIG. 1 sets forth a partial side view of an archery bow constructed in accordance with the present invention and generally referenced by numeral 10. Numeral 10 includes a riser 11 fabricated in accordance with the present invention and defining an upper beam 25 having an upper end 12, a handle support 14, and a lower beam 26 defining a lower end 13. Riser 11 receives and supports an attached overdraw guard 17 fabricated in accordance with conventional fabrication techniques and secured to riser 11 using conventional fasteners (not shown). Overdraw guard 17 further includes an arrow rest 18 extending upwardly at an angle better seen in FIG. 2. Bow 10 further includes a handle 20 secured to handle support 14 using a pair of fasteners 21 and 22. As is better seen in FIG. 2, handle 20 defines a channel 19 which facilitates fitting handle 20 upon handle support 14. Lower beam 26 further defines a cylindrical guard receptacle which, as is better seen in FIG. 6, defines a bore 62 extending therethrough. Cable guard receptacle 16 receives an insert 24 on one side and an insert 23 on the opposite side. A cable guard 15 constructed in accordance with conventional fabrication techniques is received within insert 24 of cable guard receptacle 16 to support cable guard 15 in a rigid attachment to riser 11.

Bow 10 further includes a limb pocket assembly 30 having a pocket body 34 defining a limb channel 32, upper end 12 of riser 11 by an attachment 31. In its preferred form, attachment 31 comprises a threaded fastener (seen in FIG. 5). In addition and as is better seen in FIG. 6, riser 11 defines a bore 70 extending therethrough which facilitates the passage of a threaded bolt 33 into a threaded aperture formed in body 31. Thus, bolt 33 extends through riser 11 and is threadably engaged with body 34. An elongated resilient limb 38 fabricated in accordance with conventional fabrication techniques is received within limb channel 32 and secured to limb pocket assembly 30 by a threaded bolt 35. Bolt 35 passes through a pair of washers 36 and 37 as well as an aperture formed in the lower end of limb 38 (not shown) and is threadably secured to body 34.

Similarly, lower end 13 of riser 11 supports a limb pocket assembly 40 having a pocket assembly body 44 secured to lower end 13 by an attachment 41 and a threaded bolt 43 in the manner described above for limb pocket assembly 30. By way of further similarity, body 44 defines a limb channel 42 which receives a resilient limb 48 secured therein by a bolt 45 extending through washers 46 and 47.

In the configuration shown in FIG. 1, handle 20 is received upon edge 63 of riser 11 to configure bow 10 for use by a right-handed archer. Correspondingly, limb pocket assembly 30 is secured to upper end 12 such that body 34 thereof rests against edge 66 of upper beam 25. In further correspondence with configuration of bow 10 for a right-handed archer, limb pocket assembly 40 is secured to lower end 13 of riser 11 such that body 44 thereof is secured against edge 68 of lower beam 26. To complete the configuration of bow 10 for a right-handed archer, cable guard 15 is received within insert 24 and extends outwardly beneath handle 20. Finally, overdraw guard 17 and arrow rest 16 are secured to riser 11 such that they extend from edge 65 of upper beam 25. This completes the configuration of bow 10 for use by a right-handed archer.

It will be understood by those skilled in the art that limbs 38 and 48 may utilize virtually any limb structure including recurved limbs as well as compound bow limbs. In the latter case, it will be understood that while the cable and pulley structure of a compound bow is not shown in FIGS. 1 and 2, bow 10 utilizes conventional pulley and cable arrangement together with a conventional bow string in the manner normally applied to compound bows. Thus, in the configuration of FIG. 1 corresponding to a right-handed archer, handle 20 is positioned to be grasped by the archer's left hand as the archer draws the bow string (not shown) to flex limbs 38 and 48 in the manner indicated by arrows 50 and 51 respectively. This flexing of limbs 38 and 48 of course stores energy within bow 10 which is used to launch the arrow as limbs 38 and 48 flex forwardly in the directions indicated by arrows 52 and 53 to launch the arrow. It will be apparent to those skilled in the art that a variety of limb pocket assemblies may be utilized in place of limb pocket assemblies 30 and 40. It will be equally apparent to those skilled in the art that a variety of handles and overdraw guards may also be utilized in practicing the present invention.

Figure 2:
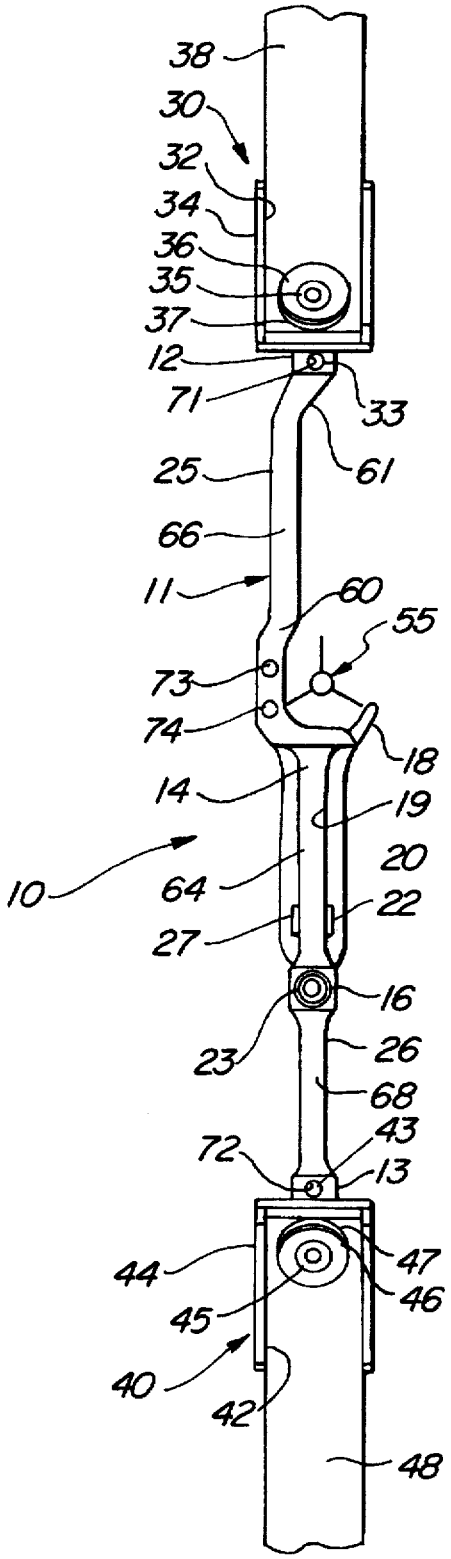
FIG. 2 sets forth a partial front view of the bow of FIG. 1 configured for use by a right-handed archer.

FIG. 2 sets forth a front view of bow 10 configured in the right hand archer's configuration of FIG. 1. Once again, it will be apparent to those skilled in the art that limbs 38 and 48 are shown in partial view and should be understood to be coupled to a conventional bowstring and cable arrangement such as that typically utilized for a compound bow or such as that utilized in conventional recurved bow fabrication. Thus, bow 10 includes a riser 11 having an upper beam 25, a handle support 14 and a lower beam 26. As described above, upper beam 25 of riser 11 supports a limb pocket assembly 30 having a body 34 defining a limb channel 32 therein. A limb 38 is received within channel 32 and secured within body 34 by a bolt 35 passing through a pair of washers 36 and 37. Bolt 35 is threadably received within upper end 12 of riser 11 to secure both body 34 and limb 38. Upper end 12 further defines a threaded bore 71 extending therethrough which receives bolt 33 (better seen in FIG. 1) to complete the attachment of body 34 of limb pocket assembly 30.

A limb pocket assembly 40 having a body 44 is secured to lower end 13 of riser 11 in the manner described above. Body 44 defines a limb channel 42 which receives a limb 48. Limb 48 and body 44 are secured to lower end 13 of riser 11 by a bolt 45 passing through washers 46 and 47 which threadably engages body 44. Lower end 13 further defines a threaded bore 72 extending therethrough within which a bolt 43 (better seen in FIG. 1) is received to complete the attachment of body 44 to lower end 13 of riser 11.

In the right hand archer configuration of bow 10, handle 20 is received upon edge 63 (seen in FIG. 1) and secured to handle support 14 by a plurality of fasteners including fasteners 22 and 23. With bow 10 configured for use by a right-handed archer, edges 66, 64 and 68 form the frontal edges of riser 11. Riser 11 further defines a cable guard receptacle portion 16 which receives an insert 23 in the manner set forth below in FIG. 6 in greater detail. Suffice it to note here that insert 23 and insert 24 (shown in FIG. 1) are utilized in securing cable guard 15 to either side of riser 11 in accordance with an important aspect of the present invention.

To facilitate the proper alignment of an arrow 55 with respect to handle 20, an upper limb 38 and lower limb 48, riser 11 defines an offset 60 directly above handle support 14 and an offset 61 directly beneath upper end 12 of riser 11. The combined effect of offsets 60 and 61 is to provide clearance for arrow 85 when arrow 85 is positioned in alignment with the vertical axis of handle support 14 and limbs 38 and 48. A pair of apertures 73 and 74 are formed within offset portion 60 of riser 11 to facilitate the attachment of overdraw guard 17 (seen in FIG. 1) and arrow rest 18. Thus, in the configuration of bow 10 shown in FIGS. 1 and 2, offsets 60 and 61 of riser 11 provide positioning of arrow 55 in the alignment shown in FIG. 2. The provision of offsets 60 and 61 is necessary to properly align arrow 55 with the vertical axis of bow 10. However, the use of offsets 60 and 61 does not render bow 10 by a left-handed archer in the configuration shown in FIGS. 1 and 2. This will be apparent by imagining a left-handed archer grasping handle 20 with the archer's right hand and drawing the bow with the archer's left hand. In such case, offsets 60 and 61 extend in the wrong direction making use of the bow in the right hand configuration awkward for a left-handed archer.

In accordance with an important aspect of the present invention set forth below in greater detail, the present invention bow utilizes riser 11 fabricated in a manner which overcomes this difficulty of right and left hand use in that riser 11 is substantially symmetrical with respect to a vertical axis extending between upper end 12 and lower end 13 when viewed from either side. That is to say, riser 11 is not symmetrical with respect to a vertical axis through the riser when viewed from either the front or back due to the use of offsets 60 and 61. Rather, riser 11 is symmetrical when viewed from either side with respect to a vertical axis extending between upper end 12 and lower end 13. Thus, the present invention bow is capable of reconfiguration for use by a left-handed archer by simply removing handle 20 and withdrawing it from edge 63 and attaching it on the opposite side of handle support 15 overlying and receiving edge 64 instead. The conversion or reconfiguration of the present invention bow from right hand to left hand configuration is completed by removing limb pockets assemblies 30 and 40 and reattaching them in a reverse position upon edges 65 and 67 respectively of riser 11. The final step in reconfiguring the present invention bow is the removal of cable guard 15 from insert 24 and its attachment to insert 23 as well as the removal of overguard 17 and arrow rest 18 from their position against edge 65 and their reattachment against edge 66. It will be apparent to those skilled in the art that bow 10 must, of course, be restrung following the removal and reattachment of limbs 38 and 48. The important aspect, however, is the ease and facility with which bow 10 is thus reconfigured from a right hand archer configuration to the left hand configuration shown in FIGS. 3 and 4.

Figure 3:
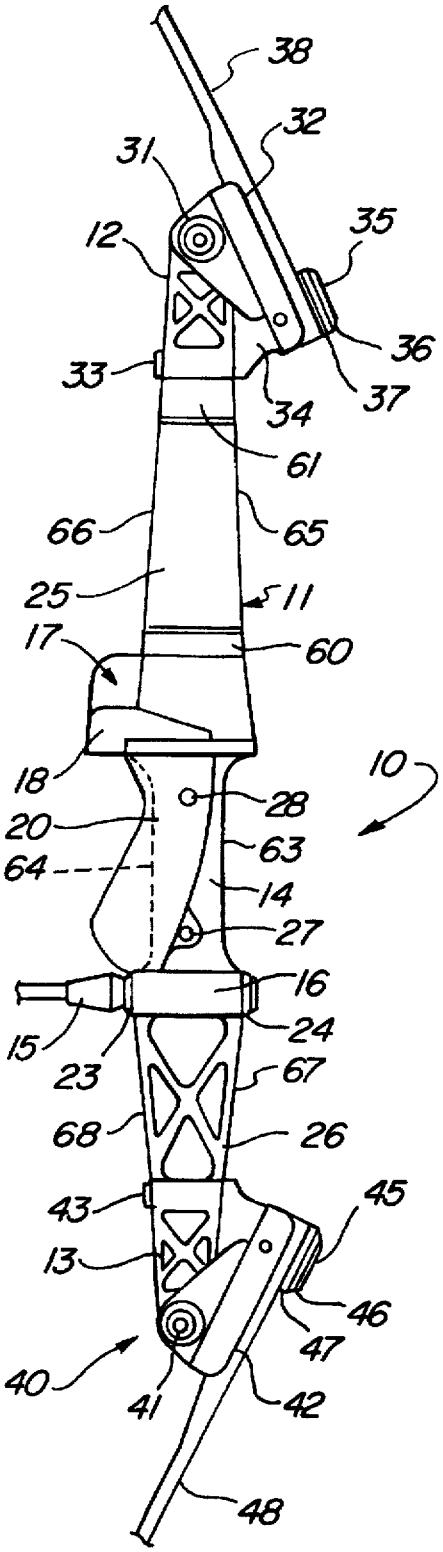
FIG. 3 sets forth a partial side view of a bow having a riser constructed in accordance with the present invention configured for use by a left-handed archer.
Figure 4:
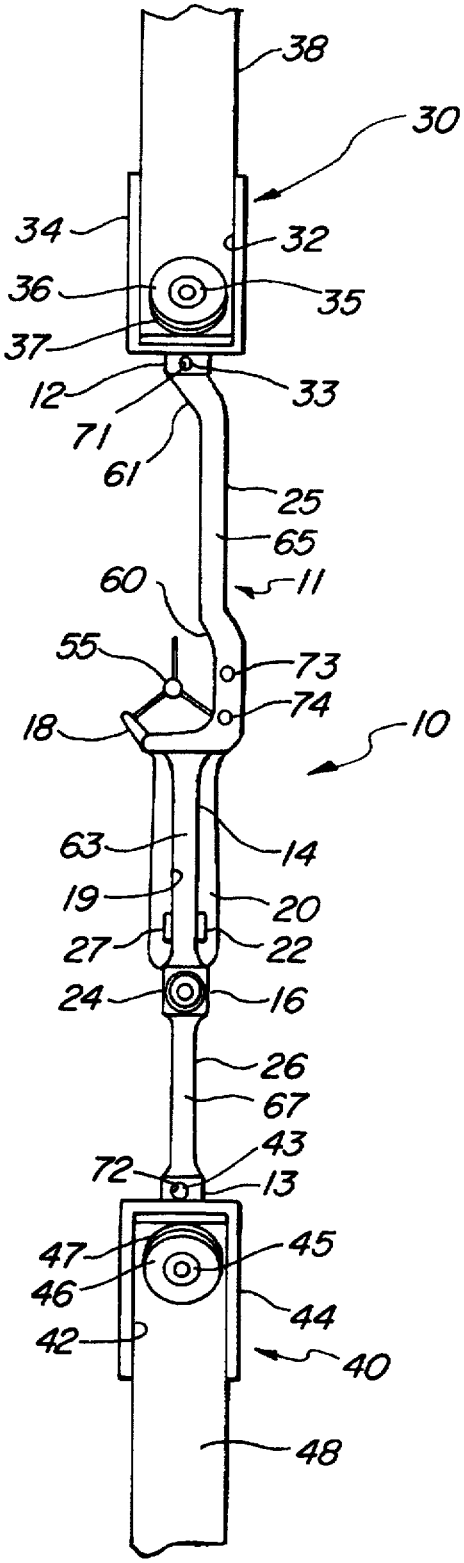
FIG. 4 sets forth a front view of the bow of FIG. 3 configured for use by a left-handed archer.

FIGS. 3 and 4 set forth a partial side view and a partial front view respectively of bow 10 in which the above-described reconfiguration from the right hand configuration shown in FIGS. 1 and 2 to the left hand configuration has been completed. It should be noted that reconfiguration is obtained by "reversing" the components attached to riser 11. In all other respects, the reconfigured bow of FIGS. 3 and 4 is the same as that shown in FIGS. 1 and 2.

FIG. 3 sets forth a partial side view of an archery bow constructed in accordance with the present invention and generally referenced by numeral 10. Numeral 10 includes a riser 11 fabricated in accordance with the present invention and defining an upper beam 25 having an upper end 12, a handle support 14, and a lower beam 26 defining a lower end 13. Riser 11 receives and supports an attached overdraw guard 17 fabricated in accordance with conventional fabrication techniques and secured to riser 11 using conventional fasteners (not shown). Overdraw guard 17 further includes an arrow rest 18 extending upwardly at an angle better seen in FIG. 4. Bow 10 further includes a handle 20 secured to handle support 14 using a pair of fasteners 21 and 22. As is better seen in FIG. 4, handle 20 defines a channel 19 which facilitates fitting handle 20 upon handle support 14. Lower beam 26 further defines a cylindrical guard receptacle which, as is better seen in FIG. 6, defines a bore 62 extending therethrough. Cable guard receptacle 16 receives an insert 24 on one side and an insert 23 on the opposite side. A cable guard 15 constructed in accordance with conventional fabrication techniques is received within insert 24 of cable guard receptacle 16 to support cable guard 15 in a rigid attachment to riser 11.

Bow 10 further includes a limb pocket assembly 30 having a pocket body 34 defining a limb channel 32, upper end 12 of riser 11 by an attachment 31. In its preferred form, attachment 31 comprises a threaded fastener (seen in FIG. 5). In addition and as is better seen in FIG. 6, riser 11 defines a bore 70 extending therethrough which facilitates the passage of a threaded bolt 33 into a threaded aperture formed in body 31. Thus, bolt 33 extends through riser 11 and is threadably engaged with body 34. An elongated resilient limb 38 fabricated in accordance with conventional fabrication techniques is received within limb channel 32 and secured to limb pocket assembly 30 by a threaded bolt 35. Bolt 35 passes through a pair of washers 36 and 37 as well as an aperture formed in the lower end of limb 38 (not shown) and is threadably secured to body 34.

Similarly, lower end 13 of riser 11 supports a limb pocket assembly 40 having a pocket assembly body 44 secured to lower end 13 by an attachment 41 and a threaded bolt 43 in the manner described above for limb pocket assembly 30. By way of further similarity, body 44 defines a limb channel 42 which receives a resilient limb 48 secured therein by a bolt 45 extending through washers 46 and 47.

In the configuration shown in FIG. 3, handle 20 is received upon edge 64 of riser 11 to configure bow 10 for use by a left-handed archer. Correspondingly, limb pocket assembly 30 is secured to upper end 12 such that body 34 thereof rests against edge 65 of upper beam 25. In further correspondence with configuration of bow 10 for a left-handed archer, limb pocket assembly 40 is secured to lower end 13 of riser 11 such that body 44 thereof is secured against edge 67 of lower beam 26. To complete the configuration of bow 10 for a left-handed archer, cable guard 15 is received within insert 23 and extends outwardly beneath handle 20. Finally, overdraw guard 17 and arrow rest 16 are secured to riser 11 such that they extend from edge 66 of upper beam 25. This completes the configuration of bow 10 for use by a left-handed archer.

It will be understood by those skilled in the art that limbs 38 and 48 may utilize virtually any limb structure including recurved limbs as well as compound bow limbs. In the latter case, it will be understood that while the cable and pulley structure of a compound bow is not shown in FIGS. 3 and 4, bow 10 utilizes conventional pulley and cable arrangement together with a conventional bow string in the manner normally applied to compound bows. Thus, in the configuration of FIG. 3 corresponding to a left-handed archer, handle 20 is positioned to be grasped by the archer's right hand as the archer draws the bow string (not shown) to flex limbs 38 and 48 in the manner indicated by arrows 55 and 56 respectively. This flexing of limbs 38 and 48 of course stores energy within bow 10 which is used to launch the arrow as limbs 38 and 48 flex forwardly in the directions indicated by arrows 57 and 58 to launch the arrow. It will be apparent to those skilled in the art that a variety of limb pocket assemblies may be utilized in place of limb pocket assemblies 30 and 40. It will be equally apparent to those skilled in the art that a variety of handles and overdraw guards may also be utilized in practicing the present invention.

FIG. 4 sets forth a front view of bow 10 configured in the left hand archer's configuration of FIG. 3. Once again, it will be apparent to those skilled in the art that limbs 38 and 48 are shown in partial view and should be understood to be coupled to a conventional bowstring and cable arrangement such as that typically utilized for a compound bow or such as that utilized in conventional recurred bow fabrication. Thus, bow 10 includes a riser 11 having an upper beam 25, a handle support 14 and a lower beam 26. As described above, upper beam 25 of riser 11 supports a limb pocket assembly 30 having a body 34 defining a limb channel 32 therein. A limb 38 is received within channel 32 and secured within body 34 by a bolt 35 passing through a pair of washers 36 and 37. Bolt 35 is threadably received within upper end 12 of riser 11 to secure both body 34 and limb 38. Upper end 12 further defines a threaded bore 71 extending therethrough which receives bolt 33 (better seen in FIG. 3) to complete the attachment of body 34 of limb pocket assembly 30.

A limb pocket assembly 40 having a body 44 is secured to lower end 13 of riser 11 in the manner described above. Body 44 defines a limb channel 42 which receives a limb 48. Limb 48 and body 44 are secured to lower end 13 of riser 11 by a bolt 45 passing through washers 46 and 47 which threadably engages body 44. Lower end 13 further defines a threaded bore 72 extending therethrough within which a bolt 43 (better seen in FIG. 3) is received to complete the attachment of body 44 to lower end 13 of riser 11.

In the left hand archer configuration of bow 10, handle 20 is received upon edge 64 (seen in FIG. 3) and secured to handle support 14 by a plurality of fasteners including fasteners 22 and 23. With bow 10 configured for use by a left-handed archer, edges 65, 63 and 67 form the frontal edges of riser 11. Riser 11 further defines a cable guard receptacle portion 16 which receives an insert 23 in the manner set forth below in FIG. 6 in greater detail.

As in the above-described right-hand use of bow 10, the proper alignment of an arrow 55 with respect to handle 20 is facilitated by an offset 60 defined on riser 11 directly above handle support 14 and an offset 61 directly beneath upper end 12 of riser 11. The combined effect of offsets 60 and 61 is to provide clearance for arrow 85 when arrow 85 is positioned in alignment with the vertical axis of handle support 14 and limbs 38 and 48. A pair of apertures 73 and 74 are formed within offset portion 60 of riser 11 to facilitate the attachment of overdraw guard 17 (seen in FIG. 3) and arrow rest 18. Thus, in the configuration of bow 10 shown in FIGS. 3 and 4, offsets 60 and 61 of riser 11 provide positioning of arrow 55 in the alignment shown in FIG. 4. The provision of offsets 60 and 61 is necessary to properly align arrow 55 with the vertical axis of bow 10.

As set forth above and in accordance with an important aspect of the present invention, the present invention bow utilizes riser 11 fabricated in a manner which overcomes this difficulty of right and left hand use in that riser 11 is substantially symmetrical with respect to a vertical axis extending between upper end 12 and lower end 13 when viewed from either side. That is to say, riser 11 is not symmetrical with respect to a vertical axis through the riser when viewed from either the front or back due to the use of offsets 60 and 61. Rather, riser 11 is symmetrical when viewed from either side with respect to a vertical axis extending between upper end 12 and lower end 13. Thus, it will be apparent by comparison of FIGS. 1 and 2 to FIGS. 3 and 4 that the present invention bow is capable of reconfiguration back to accommodate a right-handed archer again by simply removing handle 20 and withdrawing it from edge 64 and returning it to the opposite side of handle support 15 overlying and receiving edge 63 again. The reconversion or reconfiguration of the present invention bow from left hand to right hand configuration is completed by removing limb pockets assemblies 30 and 40 and reattaching them in a reverse position upon edges 66 and 68 respectively of riser 11. The final step in returning the present invention bow to a right-hand configuration is the removal of cable guard 15 from insert 23 and returning it to insert 24 together with the removal of overguard 17 and arrow rest 18 from their position against edge 66 and their reattachment against edge 65. It will be apparent to those skilled in the art that bow 10 must, of course, again be restrung following the removal and reattachment of limbs 38 and 48. The important aspect, however, is the ease and facility with which bow 10 is thus returned from a left hand archer configuration to the right hand configuration shown in FIGS. 1 and 2.

Figure 5:
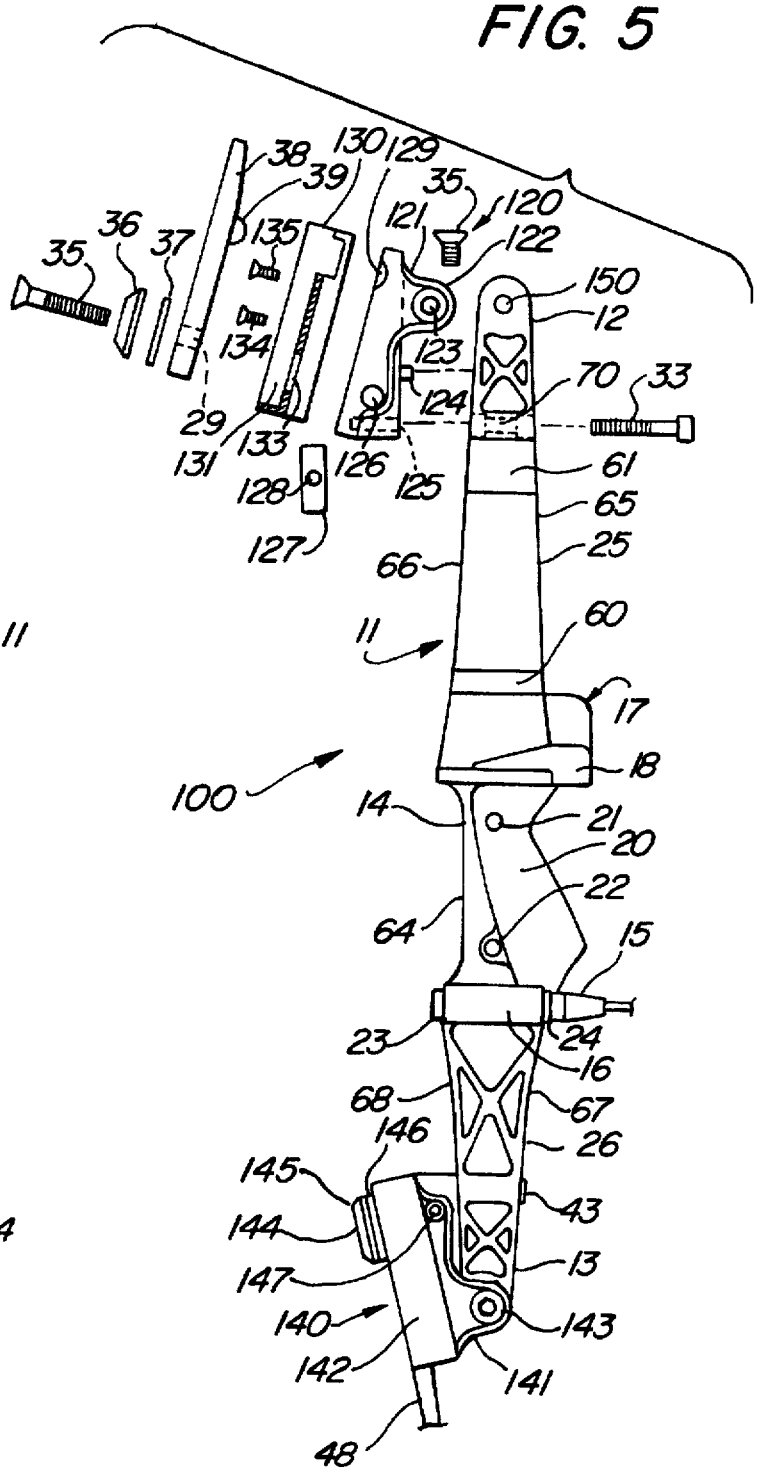
FIG. 5 sets forth a partial assembly view of a bow and riser constructed in accordance with the present invention configured for use by a right-handed archer.

FIG. 5 sets forth a partial assembly view of the present invention bow utilizing riser 11 in combination with a different pair of limb pocket assemblies generally referenced by numerals 120 and 140. Thus, bow 100 is configured in FIG. 5 in a right-handed archer configuration in which limb pocket assemblies 120 and 140 are secured to edges 66 and 68 of riser 11. Correspondingly, handle 20 is positioned upon handle support 14 together with overdraw guard 17 and arrow rest 18 to complete the right-handed configuration. Riser 11 is described above in detail and includes an upper beam 25, a handle support 14 and a lower beam 26. Upper beam 25 defines an upper end 12 having an aperture 150 together with a bore 70 formed therein. Upper beam 25 further defines edges 65 and 66 and an offset 60. Handle support 14 defines a pair of apertures 79 and 81 (seen in FIG. 6) which receive fasteners 21 and 22 respectively to secure handle 20 upon handle support 14 covering edge 63 (also better seen in FIG. 6). Lower beam 26 defines a lower end 13 defining an aperture 160 (seen in FIG. 6) together with edges 67 and 68. Riser 11 further defines a cable guard receptacle 16 which receives and supports a cable guard 15 and an insert 24. An insert 23 is further received within receptacle 16.

For purposes of illustration, limb pocket assembly 120 is shown in an exploded view while limb pocket assembly 140 is shown fully assembled and secured to lower beam 26 of riser 11. Limb pocket assembly 140 includes a body 141 secured to lower end 13 by a bolt 143. Body 141 further supports an adapter plate 142 and a limb 48 together with a transversely extending pivot pin 147. The latter is secured in the manner described below by a bolt 144 having washers 145 and 146 captivated against adapter plate 142. A bolt 43 extends through bore 164 (seen in FIG. 6) and threadably engages body 141 to complete the attachment of body 141 and limb pocket assembly 140 to riser 11.

Limb pocket assembly 120 is identical to assembly 140 and includes a body 121 defining a recess 129, an aperture 123 and a transversely extending bore 126. Body 121 further defines a threaded bore 125 and an extending pin 124. Limb pocket assembly 120 further includes an adapter plate 130 defining an aperture 132, a channel 131 and an aperture 133. Adapter plate 130 is secured to body 121 by a pair of threaded fasteners 134 and 135. A cylindrical pivot pin 127 defining a threaded aperture 128 is received within bore 126. A limb 38 having a projection 39 and an aperture 29 formed therein is received upon adapter plate 130 such that projection 39 extends through aperture 132 and is received within recess 129 of body 121. Thereafter, bolt 35 is passed through washers 36 and 37 and aperture 29 of limb 38 and aperture 133 of adapter plate 130 to be threadably received within threaded aperture 128 of pivot pin 127. Finally, body 121 is secured to upper end 12 of riser 11 by aligning apertures 123 and 150 and passing bolt 35 through aperture 123 to threadably engage aperture 150. Pin 124 is received within recess 136 formed in edge 66 of riser 11 in the manner shown in FIG. 6 to properly align body 121 upon riser 11. Assembly is completed by passing bolt 33 through bore 70 to threadably engage threaded bore 125 and complete the attachment of body 121.

Limb pocket assemblies 120 and 140 facilitate the adjustment of limb pocket angle and limb draw strength by adjusting bolts 35 and 144 within assemblies 120 and 140 respectively. This adjustment is facilitated by pivot pins 127 and 147 of assemblies 120 and 140 respectively. As described above in FIGS. 1 through 4, riser 11 is symmetrical about its vertical or elongation axis in a "front to back" sense which facilitates the configuration of limb pocket assemblies 120 and 140 together with handle 20 and overdraw guard 17 and arrow rest 18 to accommodate either right or left-handed archers. As a result, riser 11 may be utilized in a configuration in which edges 66 and 68 of riser 11 form the forward edges of the riser while edges 65 and 67 form the rear edges of the riser. Conversely, riser 11 may be configured for a left-handed archer by reversing the positions of limb pocket assemblies 120 and 140 to the opposite sides of riser 11 thereby rendering edges 65 and 67 as forward edges and edges 66 and 68 as rearward edges. In this instance, of course, handle 20 is reversed upon handle support 14 to overlie edge 64. Thus, in accordance with an important aspect of the present invention, riser 11 is configured to be symmetrical about a vertical axis of symmetry 110 (seen in FIG. 6).

Figure 6:
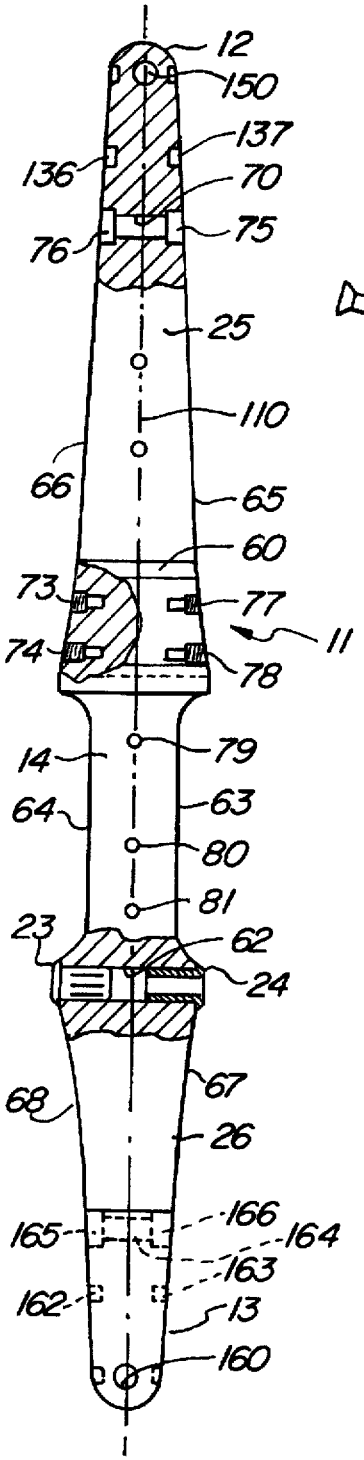
FIG. 6 sets forth a partially sectioned side view of the riser of the present invention bow.

FIG. 6 sets forth a partially sectioned side view of riser 11 having upper beam 25, handle support 14 and lower beam 26. As described above, upper beam 25 defines an upper end 12 having an aperture 150 and edges 65 and 66. Upper beam 25 defines symmetrically disposed recesses 136 and 137 extending inwardly from edges 66 and 65 respectively as well as a bore 70 having counter sunk portions 75 and 76 formed therein. Riser 11 further defines a pair of apertures 73 and 74 extending inwardly from edge 66 and a corresponding oppositely positioned pair of apertures 77 and 78 extending inwardly from edge 65. As described above, apertures 73, 74, 77 and 78 are threaded apertures to facilitate attachment of overdraw guard 17 and arrow rest 18.

Handle support 14 is similarly symmetrical about axis 110 and defines apertures 79, 80 and 81 along axis 110. Handle support 14 further defines edges 63 and 64.

Lower beam 26 of riser 11 defines a lower end 13 having edges 68 and 67 together with bore 164 extending therethrough. Bore 164 in turn defines counter sunk portions 165 and 166. Lower beam 26 further defines recesses 162 and 163 extending inwardly from edges 68 and 67 respectively. A bore 62 extends through riser 11 beneath handle support 14 and receives a pair of inserts 23 and 24. As can be seen, inserts 23 and 24 are generally hollow and cylindrical and thus receive cable guard 15 on either side of riser 11 in the manner shown in FIGS. 1 through 4. Offset 60 (better seen in FIG. 2) accommodates the correct alignment of an arrow such as arrow 55 shown in FIG. 2 in the above-described archery shooting.

In the preferred fabrication of the present invention, riser 11 is formed as an integral one-piece unit. The use of riser 11 facilitates a completely modular construction of an archery bow and thus readily accommodates changing riser length, limb pocket angle, grip position, and overdraw size parameters of an archery bow. In addition, as is set forth above, riser 11 accommodates the configuration of the modular bow to suit both right-handed and left-handed archers further adding to the flexibility and extent of use for the riser. This provision of the present invention riser and archery bow permits the archery shop to reduce the amount of inventory required and avoids the prior art practice of stocking redundant sets of right-handed and left-handed equipment to accommodate different customers. This in turn enhances the economics of archery shop management and assures a complete equipment availability for left-handed archers.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An archery bow comprising:

a riser defining an upper beam, a handle support, a lower beam and a vertical axis of symmetry extending through said riser, said riser being substantially symmetrical in a front-to-back plane passing through said axis of symmetry;

a pair of limb pocket assemblies secured to said upper beam and said lower beam;

a pair of flexible limbs secured to said pair of limb pocket assemblies; and a handle secured to said handle support, said pair of limb pocket assemblies and said handle being alternatively securable to said riser at opposed positions with respect to said axis of symmetry to configure said archery bow for left-handed and right-handed archers.

2. An archery bow as set forth in claim 1 wherein said riser defines mirror-image opposed edges on each side of said axis of symmetry.

3. An archery bow as set forth in claim 2 wherein said lower beam defines a cable guard receptacle for receiving a cable guard in alternative opposed positions with respect to said axis of symmetry.

4. For use in an archery bow, a riser comprising:

an elongated upper beam defining an offset portion, a first edge, a second edge, and a first vertical axis, said first and second edges forming substantial mirror-images with respect to said first vertical axis;

a handle support defining a third edge, a fourth edge, and a second vertical axis, said third and fourth edges forming substantial mirror images with respect to said second vertical axis; and an elongated lower beam defining a fifth edge, a sixth edge and a third vertical axis, said fifth and sixth edges forming substantial mirror images with respect to said third vertical axis, said first, second and third vertical axes being aligned to form an axis of symmetry and said offset portion of said upper beam being displaced in a direction generally perpendicular to said third and fourth edges.

5. A riser as set forth in claim 4 wherein said lower beam defines a generally cylindrical cable guard receptacle extending between said fifth and sixth edges for supporting a cable guard to extend alternatively from either said fifth edge or said sixth edge.

6. A riser as set forth in claim 4 wherein said upper and lower beams each include limb pocket assembly attaching means for alternatively attaching a pair of limb pocket assemblies to said first and fifth edges and wherein said handle support includes handle attaching means for alternatively attaching a handle to said third or fourth edge.

7. A riser as set forth in claim 4 wherein said upper and lower beams each include limb pocket assembly attaching means for alternatively attaching a pair of limb pocket assemblies to said first and fifth edges and wherein said handle support includes handle attaching means for alternatively attaching a handle to said third or fourth edge.

8. An archery bow riser comprising:

a handle support and an upper beam and a lower beam extending upwardly and downwardly therefrom;

a forward edge defined on said handle support, said upper beam and said lower beam; and a rearward edge defined on said handle support, said upper beam and said lower beam, said forward and rearward edges forming substantial mirror images with respect to a vertical axis extending through said handle and said upper and lower beams to provide a reversible riser for use by right-handed and left-handed archers.

9. An archery bow riser as set forth in claim 8 wherein said upper and lower beams each defining limb pocket assembly means on said forward and rearward edges and wherein said handle support defines handle receiving means for attaching a handle to either said forward or said rearward edge.

* * * * *